US006511622B1

(12) United States Patent
Vihtelic et al.

(10) Patent No.: US 6,511,622 B1
(45) Date of Patent: Jan. 28, 2003

(54) INVESTMENT CASTING WITH IMPROVED AS-CAST SURFACE FINISH

(75) Inventors: Joseph M. Vihtelic, Whitehall, MI (US); Alan J. Graham, Whitehall, MI (US); Robert L. McCormick, Muskegon, MI (US); Laura A. Carpenter, Muskegon, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/432,935

(22) Filed: Nov. 3, 1999

Related U.S. Application Data

(62) Division of application No. 08/736,534, filed on Oct. 24, 1996, now Pat. No. 5,983,982.

(51) Int. Cl.[7] ..... B29C 70/58
(52) U.S. Cl. ..... 264/109; 264/109; 264/219
(58) Field of Search ..... 264/109, 219; 428/402

(56) References Cited

U.S. PATENT DOCUMENTS

| | | | | |
|---|---|---|---|---|
| 3,316,105 | A | 4/1967 | Feagin et al. | |
| 3,655,414 | A | 4/1972 | Hoffman et al. | |
| 3,667,979 | A | 6/1972 | Merges et al. | |
| 3,704,145 | A | 11/1972 | Ware et al. | |
| 3,717,485 | A | 2/1973 | Larson | |
| 3,754,943 | A | 8/1973 | Solomon | |
| 3,801,335 | A | 4/1974 | Larson | |
| 3,822,138 | A | 7/1974 | Noguchi et al. | 106/38.6 X |
| 3,854,962 | A | 12/1974 | Speyer | |
| 3,880,790 | A | 4/1975 | McLaren et al. | |
| 3,884,708 | A | 5/1975 | Burkert | |
| 3,887,382 | A | 6/1975 | Solomon | |
| 4,919,193 | A | 4/1990 | Sasaki | 164/516 |
| 5,006,583 | A | 4/1991 | Argueso | 524/277 |
| 5,176,188 | A | 1/1993 | Quinn et al. | 164/34 X |
| 5,185,108 | A | 2/1993 | Shimandle | 264/11 |
| 5,270,360 | A | 12/1993 | Solomon | 524/77 |

FOREIGN PATENT DOCUMENTS

| | | |
|---|---|---|
| JP | 50-7722 | 1/1975 |
| JP | 57 187 207 | 1/1982 |

OTHER PUBLICATIONS

Metals Handbook, 9th Edition, vol. 7, pp. 25–29.

Abstract of Japanese Patent Publication 57–187 207, Published Nov. 17, 1982.

Atomization (XP–002053186) pp. 26–29.

*Primary Examiner*—Mary Lynn Theisen

(57) ABSTRACT

An investment casting method using a pattern material with substantially spherical filler particulates is used to produce investment cast components with improved surface quality, reduced finishing costs, and reduced core breakage. The pattern material comprises substantially spherical particles within the particle size range of about 10 microns to about 70 microns particle diameter, the use of which reduces the number of random, localized surface depressions and pits to improve pattern surface texture and uniformity. Patterns so formed impart the same improvements to the surface of subsequent investment cast components. The resulting castings exhibit improved as-cast surface finish and reduced random, localized surface pitting, thereby reducing or eliminating expensive post casting surface finishing operations. Moreover, the spherical morphology of the filler particulates reduces injection pressures to fill a pattern die cavity as compared to non-spherical filler particulates. The lower injection pressures eliminate or reduce breakage of ceramic cores positioned in the die cavity for manufacture of hollow cast components, such as internally cooled turbine blades and vanes.

6 Claims, 4 Drawing Sheets

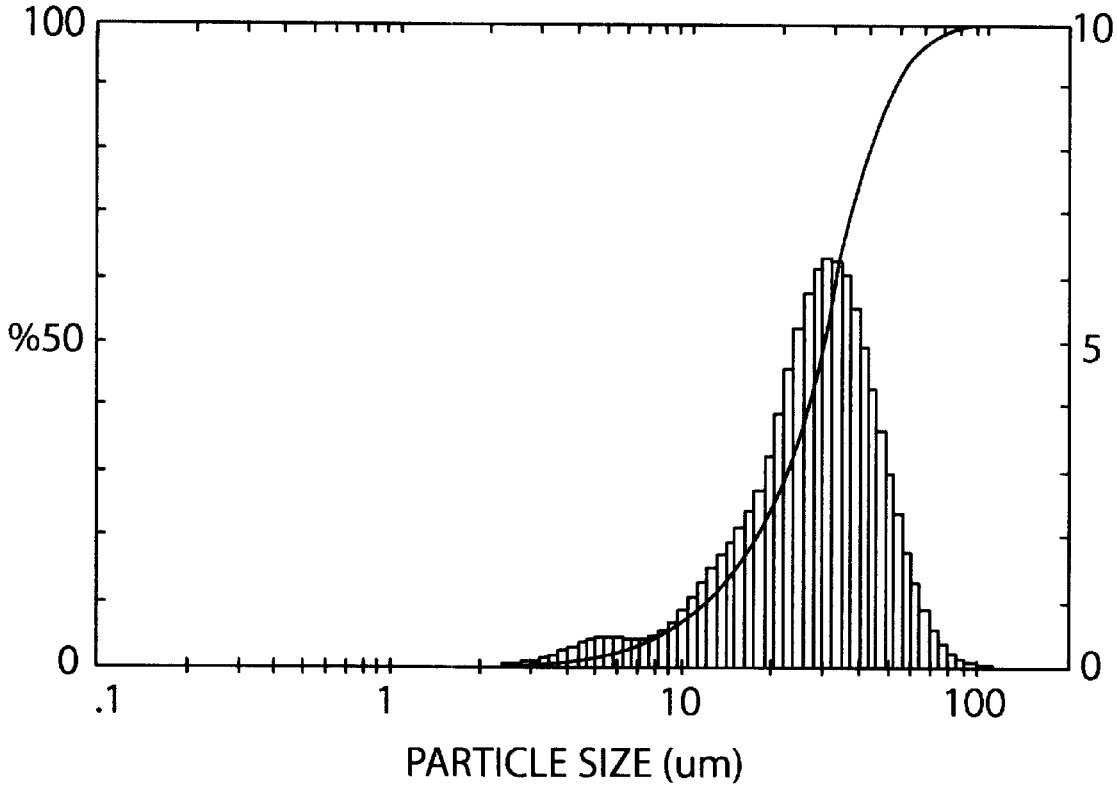
FIG. 5
FIG. 6
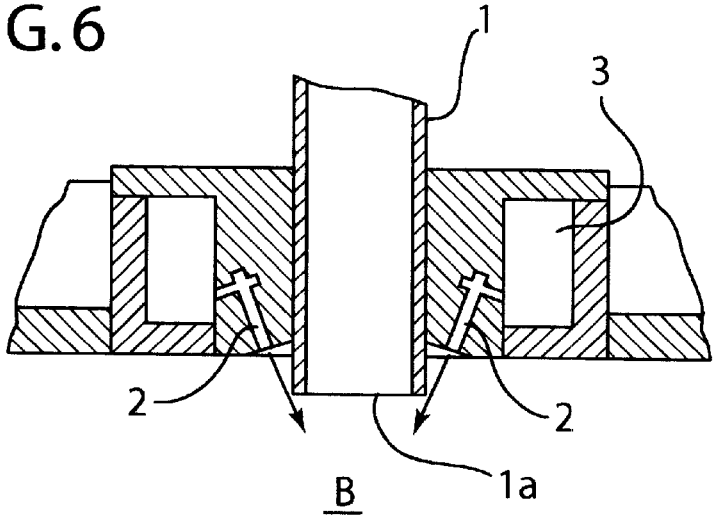

INVESTMENT CASTING WITH IMPROVED AS-CAST SURFACE FINISH

This is a division of Ser. No. 08/736 534, filed Oct. 24, 1996 now U.S. Pat. No. 5,983,982.

FIELD OF THE INVENTION

The present invention relates to the investment casting of metal in a mold made using a disposable pattern, more particularly, to investment casting in a manner to improve as-cast surface finish of the cast component as well as to provide an improved pattern material.

BACKGROUND OF THE INVENTION

Investment casting is widely used in the manufacture of myriad cast components including complex gas turbine engine components, such as blades and vanes made of nickel or cobalt base superalloys. In the investment casting process, a wax or other disposable pattern of the component to be cast is made typically by injecting molten wax into a pattern die cavity and solidifying the material in the die cavity. Ceramic mold material then is coated on or invested about the pattern to form a casting mold upon selective removal of the pattern by heating (melting), chemical dissolution or other conventional pattern removal technique. The ceramic investment mold typically is fired to develop mold strength, and then molten metal is cast into the mold and solidified to form the cast component, which will have the configuration of the pattern employed to make the mold.

Existing wax pattern materials normally contain a stable, solid filler material, such as for example only 4,4-isopropylindene diphenol available as Bisphenol A (BPA) or cross-linked polystyrene, which results in wax properties that limit dimensional distortion, reduce visual defects, control shrinkage, and improve dewax capabilities. Presently used filler material is a mechanically ground material that is characterized by angular surface configuration, such as an acicular particle configuration and/or fiber-like particle configuration. This filler morphology creates significant undesirable side effects which include rough and pitted casting surfaces that require extensive post-casting finishing operations and increased wax injection pressures into the pattern die cavity during pattern fabrication. Such increased wax injection pressures in the pattern die cavity can break fragile ceramic cores positioned in the die cavity and about which the wax is injected in the manufacture of wax/core pattern assemblies for use in casting hollow components, such as internally cooled turbine blades and vanes.

An object of the present invention is to provide an investment casting method conducted in a manner to improve as-cast surface of the cast component and to reduce the extent of post-casting surface finishing operations.

Another object of the present invention is to provide an improved pattern material and pattern for use in forming a refractory casting mold for use in investment casting methods.

SUMMARY OF THE INVENTION

The present invention provides an investment casting method in which a pattern material including one or more matrix constituents and substantially spherical filler particulates in a certain size range is formed into a pattern configuration of the component to be cast. The spherical filler particulate size range is selected effective to improve as-cast surface finish of the cast component by providing an improved, uniform pattern surface texture characterized by substantially reduced random, localized surface depressions and pits. The improved, uniform pattern surface is imparted to the component cast in a mold made using the pattern.

In particular, the component cast in the mold exhibits an improved as-cast surface finish with improved, much more uniform surface texture with reduced random, localized surface pitting and other gross surface defects so as to, in turn, reduce the extent of post-casting surface finishing operations. Moreover, the pattern material can be injected into a pattern die cavity at a lower injection pressure that reduces breakage of a ceramic core positioned in the die cavity in the manufacture of wax/core pattern assemblies for use in casting hollow components, such as internally cooled turbine blades and vanes.

In one embodiment of the present invention, the pattern material comprises one or more heat meltable wax and/or resin matrix constituents and substantially spherical filler particulates within a particle size range of about 10 microns to about 70 microns particle diameter effective to improve as-cast surface finish of a nickel or cobalt superalloy casting. The aforementioned objects and advantages of the present invention will become more readily apparent from the following detailed description of the invention taken with the following drawings.

DESCRIPTION OF THE DRAWINGS

FIG. 5 is a particle size distribution graph for the spherical filler particulates used in the Example described herebelow.

FIG. 6 is a partial sectional view of an atomizer to make substantially spherical filler particulates.

DETAILED DESCRIPTION OF THE INVENTION

Figure 1:
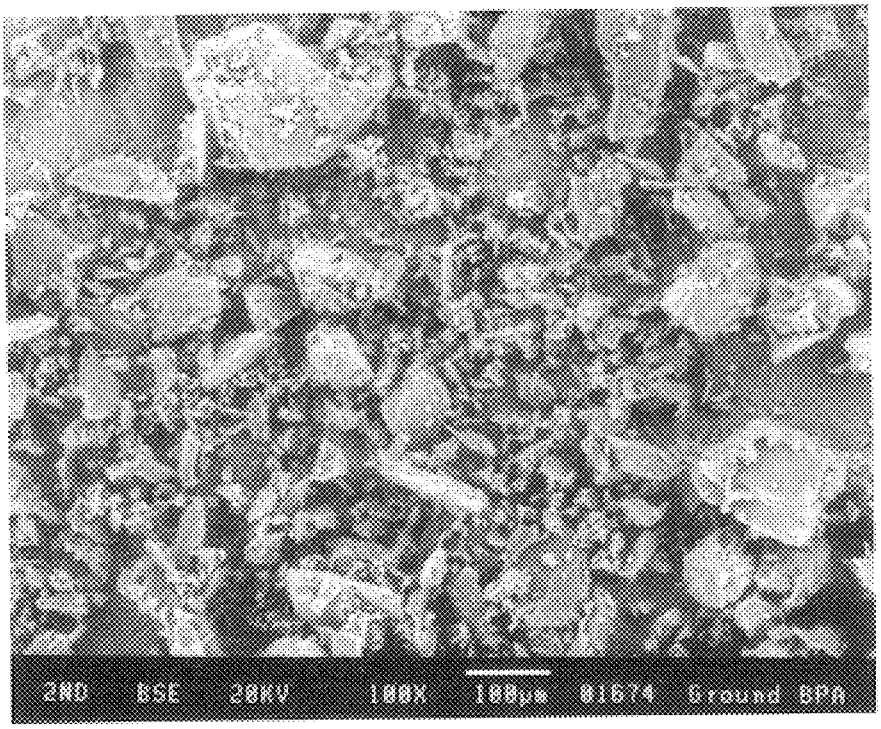
FIG. 1 is a photograph at 100× of ground BPA filler particulates used previously in prior art pattern material.

The present invention embodies an improved pattern material for use in investment casting methods. The pattern material comprises one or more matrix components or constituents, such as petroleum wax and/or natural or synthetic resins, and solid filler particulates having a substantially spherical particle shape and having a particle size in a range discovered effective to improve as-cast surface finish of metal components cast in investment molds made using the pattern material.

For purposes of illustration and not limitation, the invention will be described in detail herebelow with respect to a pattern material for use in forming patterns and investment casting shell molds by the conventional "lost wax" process for use in casting nickel base or cobalt superalloy components.

A pattern material in accordance with one embodiment of the present invention typically comprises one or more petroleum waxes (e.g. a paraffin wax and a microcrystalline wax) and a hydrocarbon resin such Eastotac H-130 as the matrix constituents, stearic acid as a flow enhancer and adhesive agent, and substantially spherical solid filler particulates in a particle size range found effective to improve as-cast surface finish of the component cast in a refractory mold using the pattern material. An exemplary pattern material pursuant to a working embodiment of the invention comprises the following:

| | |
|---|---|
| hydrocarbon resin (Eastotac H-130) | 29.25% by weight |
| microcrystalline wax | 6.50% by weight |
| stearic acid | 13.00% by weight |
| paraffin wax | 16.25% by weight |
| spherical filler | 35.00% by weight |

The hydrocarbon resin (Eastotac H-130) is available as solid flake from Eastman Chemical Co., Kingsport, Tennessee, and has a melting point of 130 Degrees C as determined by ASTM standard E-28. The microcrystalline wax is available as a solid slab from Bareco Products, Rock Hill, S.C. and has a melting point of 180 degrees F as determined by ASTM standard D-127-63. The paraffin wax is available as a solid slab from Moore & Munger-Marketing, Inc., Shelton, Connecticut, and has a melting point of 152 degrees F as determined by ASTM standard D-127-63.

The spherical filler particulates comprise in the illustrative working embodiment Bisphenol A (BPA) available from Aristech Chemical Corporation, Pittsburgh, Penn., although the invention is not limited thereto and can be practiced using other spherical filler particulates such as cross-linked polystyrene and other suitable polymeric and/or organic crystalline materials. Importantly, the filler particles are made to have a substantially spherical shape with a particle size in the range of about 10 microns to about 70 microns particle diameter discovered to significantly improve the as-cast surface finish of superalloy castings made in ceramic shell molds produced using the pattern material. Filler particles having a particle diameter less than about 10 microns are not suitable because they produce visual quality defects such as flow lines and entrapped air (air locks) during pattern injection. Filler particles having a particle diameter greater than about 70 microns are not suitable because they cause unacceptably rough pattern surfaces, and high injection pressures.

A preferred size range for the substantially spherical filler particles comprises a median particle size that falls in a range from about 25 microns to about 35 microns diameter, and more preferably from about 27 microns to about 33 microns diameter, to provide a tight or relatively narrow particle size distribution that avoids localized, random pits or other surface depressions in the pattern surface.

An inert gas atomization method can be used to produce the substantially spherical shaped filler particles for practice of the invention. For example, the aforementioned bisphenol A (BPA) is heated to a liquid at 350 degrees F for atomization by room temperature argon gas at a pressure of 240 psi using 30–45 cubic feet per minute argon for 100 pounds per hour of liquid. The liquid is discharged from a nozzle 1 having a discharge orifice 1*a* with a diameter of ⅛ inch and atomized by twenty (20) argon gas jets discharged from individual argon gas discharge orifices 2 each having a diameter of 0.030 inch and receiving argon from a gas manifold 3 communicated to a source of argon, FIG. 6. The argon gas discharge orifices 2 of the atomizer are disposed in a circle equally spaced apart about the discharge orifice 1*a* and axially spaced from it by a distance of about 0.125 inch, the gas jets being oriented at 45 degree angle to the longitudinal axis of nozzle 1 to form a spray of atomized droplets that are collected in a bin B, which is essentially purged of air over time by the argon atomizing gas, and that solidify as substantially spherical particles. The atomized generally spherical filler particles are collected and passed through a 120 mesh screen for blending or mixing with the pattern material. The invention is not limited to producing the generally spherical particles by inert gas atomization in the manner described since the substantially spherical filler particulates can be produced by other methods such as including, but not limited to, centrifugal atomization, water and steam atomization, and emulsification processes.

Figure 2:
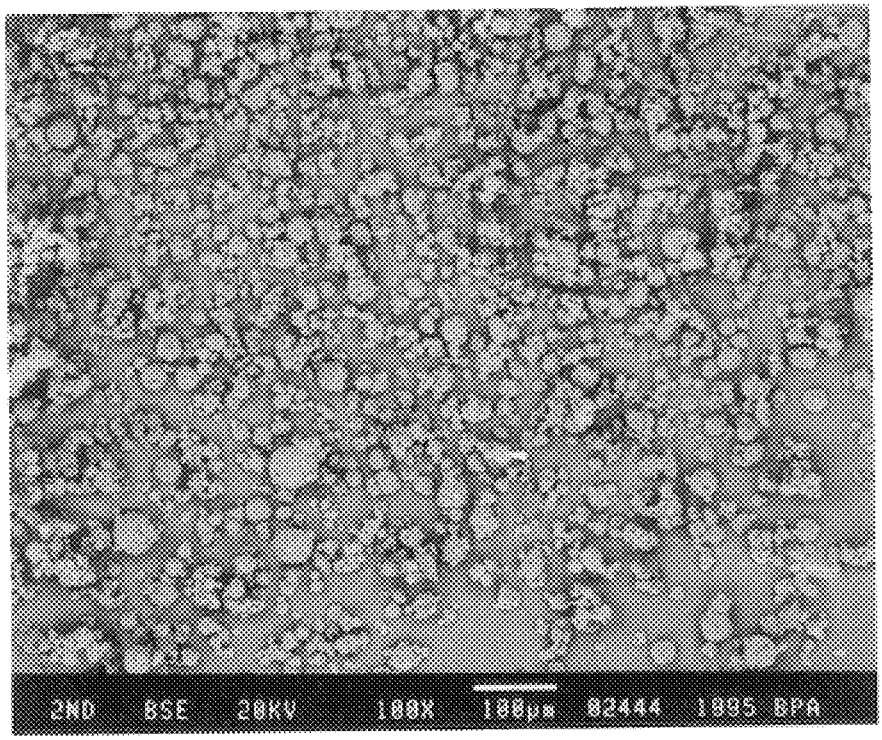
FIG. 2 is a photograph at 100× of substantially spherical BPA filler particulates used in pattern materials in accordance with the present invention.

The substantially spherical particulates, FIG. 2, contrast to the typical acicular and fibrous type filler particles heretofore used and produced by grinding FIG. 1.

The filler particles may be present in the pattern material in amounts ranging from about 20 weight % to about 40 weight % of the total pattern material, although 35 to 40 weight % is preferred.

The aforementioned pattern components or constituents are blended together by mechanical mixing to yield a pattern material having the spherical solid filler particulates uniformly distributed in the matrix constituents. The resulting pattern material has a viscosity of about 200 cps to about 2000 cps (centipoise) suitable for injection under presssure into a conventional pattern die cavity.

The blended pattern material typically is injected into a metal pattern die cavity having the exact pattern shape (of the article to be cast) in the pressure range of 35 to 300 psi which is low enough to avoid breaking or cracking a ceramic core which may be present in the pattern die cavity to form a pattern/core pattern assembly for making hollow castings. For making solid airfoil components, these injection pressures are high enough to fill fine part features to be ultimately cast in the component. In particular, the ceramic core may be a relatively thin cross-section silica, alumina or other core of the type typically used in the casting of hollow gas turbine engine blades or vanes having as-cast internal cooling air passages. Such thin ceramic cores have experienced breakage or cracking in the past using the higher injection pressures needed for prior pattern materials having acicular solid filler particulates.

The disposable, heat meltable pattern formed by injection molding in the pattern die cavity can be coated or invested with a refractory mold material using conventional "lost wax" mold making procedures to form a casting shell mold about the pattern. For example, the injected molded pattern can be repeatedly dipped in an appropriate aqueous slurry of fine ceramic powder or flour and binder agent to build up a facecoat layer that contacts the molten metal cast in the mold. The pattern then is repeatedly dipped in an appropriate slurry of fine or coarse ceramic particles and dusted or stuccoed with coarse ceramic particles while the slurry is still wet to build up a ceramic shell mold of suitable wall thickness on the pattern. The particular ceramic particles for the mold materials are selected in dependence on the metal composition to be cast. The Examples set forth below describe particular ceramic shell mold parameters for purposes of illustration and not limitation.

The pattern is selectively removed from the refractory or ceramic mold by melting, dissolution or other conventional pattern removal techniques. For example, the green ceramic shell mold with the pattern therein formed by the "lost wax" technique can be placed in a conventional furnace and heated to melt the pattern and allow it flow out of the mold. Alternately, microwave heating may be employed to selectively melt the pattern from the shell mold. During the pattern removal step, both the pattern matrix constituents and some or all of the spherical filler particulates are melted for removal from the green mold. Any unmelted spherical filler particles flow out of the green mold easily as compared to flow of acicular filler previously used.

Following the pattern removal step, the investment shell mold can be heated or fired in conventional manner at a suitable elevated temperature to develop sufficient mold strength for casting molten metal therein. The mold heating temperature will depend on the refractory or ceramic mold materials and binders employed in mold fabrication.

Molten metal, such as nickel and cobalt base superlloys, then can be conventionally cast into the investment shell mold and solidified therein to form a cast component. The casting technique can be selected from conventional, well known techniques to produce equiaxed grain casting, columnar grain casting or single crystal casting. Use of the pattern material in accordance with an embodiment of the invention yields a cast component having an as-cast surface finish that is an exact replicate of the pattern down to microscopic surface texture characteristics and is significantly improved in terms of having improved, much more uniform surface texture with reduced localized surface pitting so as to, in turn, reduce the extent of post-casting surface finishing operations. A comparison of FIGS. 3 and 4 reveals the improved pattern uniform surface texture and reduced random localized surface pitting and gross surface defects achieved by practice of the invention (FIG. 4).

The following Example is offered to illustrate the invention in greater detail but not to limit the scope of the invention in any way.

EXAMPLE

The particle size distribution of the spherical BPA filler particles (Bisphenol A particles argon gas atomized as described hereabove) used in this Example is shown in FIG. 5. A Malvern Instruments particle size analyzer, using laser scattering of particles suspended in dry air, was used to measure the filler particle size distribution. The results of the analysis showed that the median particle size of the generally spherical filler particles was about 28 microns diameter. The particle size under 10 percentile was about 10–15 microns, while particle size over 90 percentile was about 40–60 microns. The spherical BPA filler particles were screened and mixed with the pattern material components and in proportions described hereabove for the exemplary pattern material. The surface of a solid airfoil shaped pattern pursuant to the invention made using the exemplary pattern material injected into a pattern die at approximately 200 psi is shown in FIG. 4.

Figure 3:
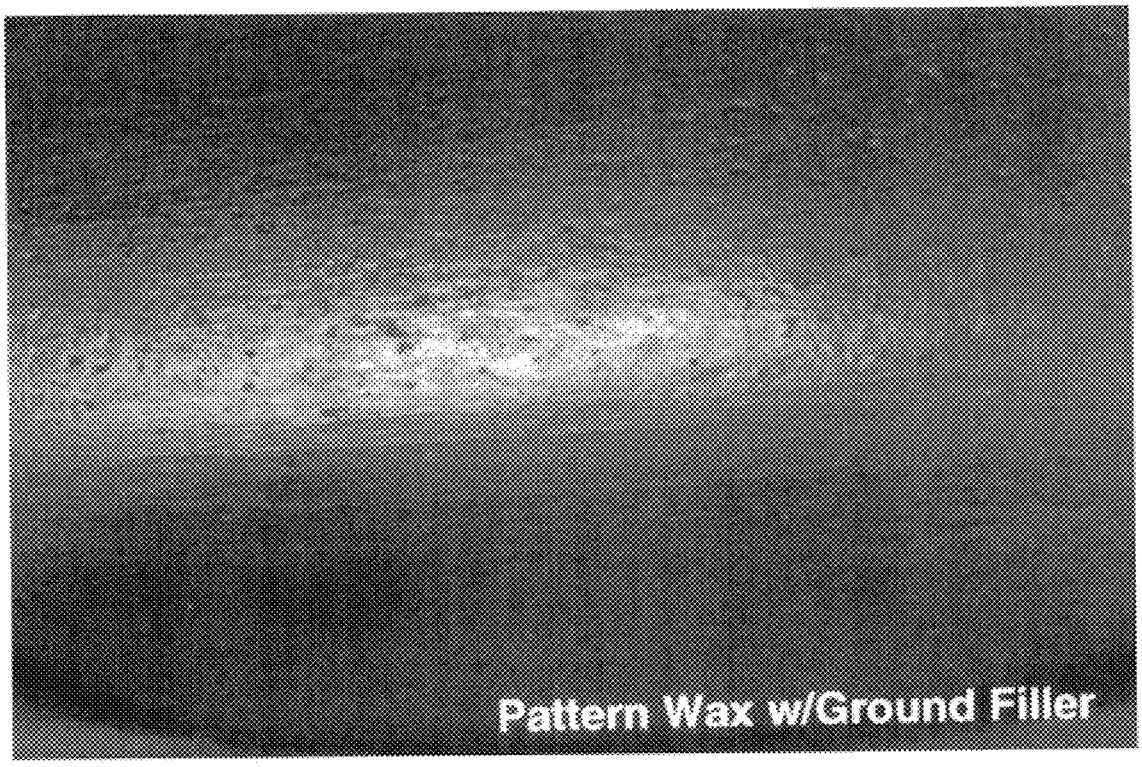
FIG. 3 is a photograph at 10× of a wax pattern surface produced using a pattern material including the ground BPA filler particulates of FIG. 1 having acicular and/or fiber particle configuration.
Figure 4:
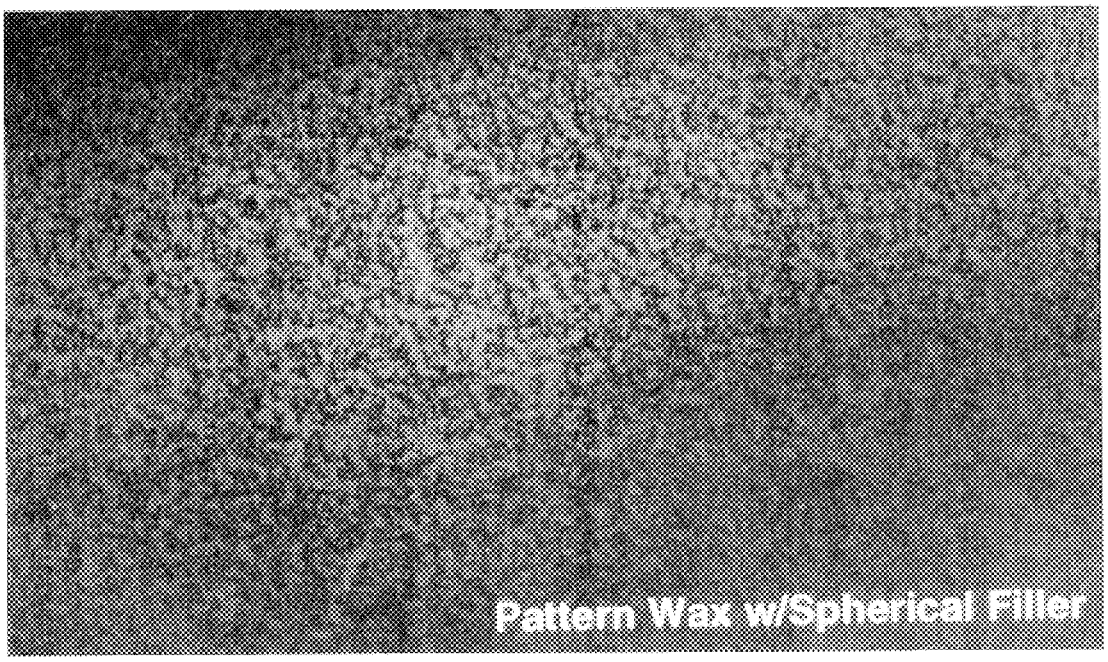
FIG. 4 is a photograph at 10× of a pattern surface produced using a pattern including spherical BPA filler particulates of FIG. 2 pursuant to the invention.

For comparison, in FIG. 3, the surface of an airfoil shaped pattern made using a pattern material having the solid acicular and angular BPA filler particles of FIG. 1 mixed with like pattern material components in like proportions as the exemplary pattern material is shown and characterized as including unacceptable gross or severe randomly located, localized surface depressions or pits and surface roughness measured in the range of 95 to 142 rms (root mean square). The noted random, localized surface depression and pit defects in the pattern surface will be reflected in a component cast in a mold made using the pattern. Such a casting would need extensive post-casting surface finishing operations to remove such severe random, localized deep surface defects.

In contrast, in FIG. 4, the surface of the pattern made using the exemplary pattern material including solid spherical filler particulates described hereabove pursuant to the invention is characterized as including reduced localized surface pitting and reduced surface roughness measured in the range of 75 to 130 rms. A more uniform pattern surface generally is evident in FIG. 4 with little or no gross or severe random, localized surface defects such as random deep depressions and pits that render casting finishing problematic. The more uniform surface of FIG. 4 imparted to a casting can be easily finished to bring the casting surface finish within customer specifications as a result of the avoidance of the gross or severe localized surface defects such as deep depressions and pits evident in FIG. 3.

That is, the pattern surface of FIG. 4 will produce a similarly improved as-cast surface on a component cast in an investment mold made using that pattern by conventional lost-wax procdures (e.g. as an as-cast surface having an improved surface texture with reduced severe random, localized surface depressions or pitting), thereby requiring much less extensive surface finishing operations, such as grinding, belting, and polishing, to remove surface defects and thus less removal of metal from the casting surface (as compared to a casting made in a mold using the pattern shown in FIG. 3). The improved, uniform pattern surface texture with reduced localized surface pits and the like imparted to the cast component may enable the component to be used in the as-cast condition without traditional casting surface finishing. The invention can be used in conjunction with conventional investment casting techniques wherein a mold is formed about disposable pattern of a component to be cast, the pattern is removed, and molten metal is cast into the mold to form a cast component to produce equiaxed, columnar grain or single crystal castings of nickel and cobalt base superalloys as well as other metals and alloys with improved as-cast surface finish of the cast component.

The invention is advantageous to improve as-cast surface finish of a cast component so that the extent of post-casting surface finishing operations and metal removal from the casting is substantially reduced and possibly eliminated altogether so that casting can be used as-cast. Moreover, castings made using patterns with improved, more uniform surface texture pursuant to the invention can be surface finished using automated finishing operations, such as media finishing, that are less costly. Still further, castings made using patterns with improved, more uniform surface texture pursuant to the invention will exhibit a significant reduction in scrap due to wall scrap, which can result from excessive finishing operations to remove unacceptable surface defects. In particular, the more metal that is removed or modified in a post-casting operation to repair or remove surface pit defects on a hollow casting will result in greater wall thickness variation of the hollow casting. Since wall thickness specifications have become a critical quality characteristic in new high performance airfoil casting designs, the invention is advantageous in reducing the extent of post-casting finishing operations needed, wall thickness variations, and scrap due to out-of-specification wall thickness.

While the invention has been described in terms of specific illustrative embodiments thereof, it is not intended to be limited thereto. Moreover, although certain embodiments of the invention have been shown and described in detail hereabove, those skilled in the art will appreciate that changes, modifications and omissions can be made therein without departing from the scope of the invention as set forth in the appended claims.

What is claimed is:

1. A method of forming a disposable pattern of an article to be cast, comprising mixing atomized, generally spherical, solid filler particulates and a pattern matrix material to form a mixture, and forming the mixture to a pattern shape of the article to be cast.

2. The method of claim 1 wherein said particulates have a median particle size within the range of about 25 microns to about 35 microns particle diameter.

3. The method of claim 1 wherein said particulates are in the size range of about 10 microns to about 70 microns particle diameter.

4. The method of claim 1 where said particulates comprise atomized generally spherical 4,4-isopropylidene diphenol.

5. The method of claim 1 wherein the mixture comprises about 20 weight % to about 40 weight % particulates.

6. The method of claim 1 wherein said mixture has a viscosity for injection into a die cavity in the range of 200 cps to 2000 cps and is injected under pressure into the die cavity to form a pattern shape.

* * * * *